US007427212B2

(12) United States Patent
Hyun et al.

(10) Patent No.: US 7,427,212 B2
(45) Date of Patent: Sep. 23, 2008

(54) CONNECTOR FOR A DISPLAY APPARATUS

(75) Inventors: Min-Gwan Hyun, Seoul (KR); Jeoung-Gwen Lee, Suwon-si (KR); Jin-Soo Shin, Hwaseong-si (KR); Wee-Joon Jeong, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/960,250

(22) Filed: Dec. 19, 2007

(65) Prior Publication Data

US 2008/0096402 A1 Apr. 24, 2008

Related U.S. Application Data

(62) Division of application No. 11/449,471, filed on Jun. 7, 2006, now Pat. No. 7,331,815.

(30) Foreign Application Priority Data

Aug. 19, 2005 (KR) ..... 10-2005-76217

(51) Int. Cl.
*H01R 12/24* (2006.01)

(52) U.S. Cl. ..... 439/495; 439/260; 439/329

(58) Field of Classification Search ..... 439/329, 439/260, 495

See application file for complete search history.

(56) References Cited

U.S. PATENT DOCUMENTS

| | | | | |
|---|---|---|---|---|
| 6,056,571 | A | 5/2000 | Noro | |
| 6,200,150 | B1 * | 3/2001 | Hsu | 439/260 |
| 6,494,781 | B2 * | 12/2002 | Fujita et al. | 439/635 |
| 6,790,074 | B1 | 9/2004 | Chiu | |
| 6,921,274 | B2 | 7/2005 | Yu | |
| 7,134,891 | B2 * | 11/2006 | Kayama et al. | 439/260 |

* cited by examiner

*Primary Examiner*—Truc T Nguyen
(74) *Attorney, Agent, or Firm*—MacPherson Kwok Chen & Heid LLP

(57) ABSTRACT

A connector that is capable of reducing defects in display apparatuses is presented. The connector includes a body, a plurality of terminals and a cover. The body has a base and a sidewall. The terminals are disposed on the body and arranged to make an electrical connection with the electrical circuit when the electrical circuit is received by the body. The cover includes a rotation axis, a fixing portion extending from the rotation axis such that the fixing portion is substantially parallel to the base of the body, and a protrusion portion protruding from the rotation axis substantially perpendicularly to the base of the body. The connector prevents electrical discharge from the flexible printed circuit board to the electrical circuit and prevents physical damage to the electrical circuit. Therefore, defect rate decreases and a yield of a display apparatus increases.

7 Claims, 6 Drawing Sheets

CONNECTOR FOR A DISPLAY APPARATUS

CROSS-REFERENCE TO RELATED APPLICATIONS

This application is a Divisional of U.S. patent application Ser. No. 11/449,471 filed on Jun. 7, 2006, now allowed, which claims priority to and the benefit of Korean Patent Application No. 10-2005-76217, filed Aug. 19, 2005, the disclosures of which are incorporated herein by reference in their entireties.

BACKGROUND OF THE INVENTION

1. Field of the Invention

The present invention relates to a connector, a method of connecting a flexible circuit board to a control board by using the connector and a display apparatus including the connector. More particularly, the present invention relates to a connector capable of reducing defect rate, a method of connecting a flexible circuit board to a control board by using the connector and a display apparatus including the connector.

2. Description of the Related Art

Today, a flat-type display apparatus is widely employed in various image display apparatuses such as a mobile communication terminal, a digital camera, a notebook computer, a monitor, etc. The reason behind the popularity of flat-typed display apparatuses includes advantageous characteristics such as light weight and thinness. There are different types of flat-typed display apparatuses, such as a liquid crystal display (LCD) apparatus, an organic light emitting display (OLED) apparatus, and a plasma display panel (PDP), among others. Of the different types of flat-type display apparatuses, the liquid crystal display apparatus has particularly desirable characteristics such as a relatively low power-consumption and a relatively small size.

Generally, the display apparatus includes a display panel, a gate driving circuit, a data driving circuit and a control printed circuit board. The display panel includes an array substrate and a counter substrate that can be assembled with the array substrate.

The array substrate includes a plurality of gate lines, a plurality of data lines and a plurality of switching elements. The counter substrate can be combined with the array substrate. The gate driving circuit includes a plurality of thin film transistors, and applies the gate signal to the gate lines. The data driving circuit applies the data signal to the data lines. The control printed circuit board is electrically connected to the data driving circuit board to control the gate driving circuit and the data driving circuit.

The control printed circuit board is electrically connected to the data driving circuit through a flexible circuit board. Upon initially establishing electrical connection between the flexible circuit board and the control printed circuit board, a static charge that was stored in the flexible circuit board causes electrical damage to the control printed circuit board. Further, when the flexible circuit board scratches a surface of the control printed circuit board during the electrical connection process, the surface of the control printed circuit board is physically damaged.

Particularly, the control printed circuit board is easily damaged by electrical and physical impacts when the flexible circuit board is arranged on the control printed circuit board such as to couple the flexible circuit board to the control printed circuit board.

SUMMARY OF THE INVENTION

The present invention provides a connector capable of reducing the defect rate. The present invention also provides a method of connecting the above connector to an electrical circuit. The present invention also provides a display apparatus including the above connector.

In one aspect, the present invention is a connector including a body, a plurality of terminals, and a cover. The body has a base and a sidewall. The terminals are disposed on the body and arranged to make an electrical connection with an electrical circuit. The cover includes a rotation axis that is coupled to the terminals, a fixing portion extending from the rotation axis to hold the electrical circuit in place such that the fixing portion is substantially parallel to the base of the body, and a protrusion portion protruding from the rotation axis.

In another aspect, the present invention is a method of connecting a first electrical circuit having a conductive pattern to a second electrical circuit. The method entails providing a connector that includes a body having a base and a sidewall, a plurality of terminals on the body, and a cover. The cover includes a rotation axis coupled to an upper portion of the body, a fixing portion extending from the rotation axis in a predetermined direction, and a protrusion portion protruding from the rotation axis. The method further entails disposing the first electrical circuit over the cover such that an end portion of the first electrical circuit makes contact with the protrusion portion. The cover is rotated in a first rotational direction around the rotation axis such that the conductive pattern of the first electrical circuit makes contact with the terminals. The cover is rotated in a second rotational direction opposite to the first rotational direction such that the first electrical circuit is inserted under the cover and the conductive pattern of the first electrical circuit makes contact with the terminals. The second electrical circuit is electrically attached to the body of the connector.

In yet another aspect, the present invention is a display apparatus that includes a backlight assembly, a display panel, a driving part, a printed circuit board and a connecting member. The backlight assembly generates light. The display panel displays an image using the light. The driving part generates a driving signal. The printed circuit board controls the driving signal to apply the driving signal to the display panel. The connecting member electrically connects the driving part to the printed circuit board to transmit the driving signal. The connector includes a body having a base and a sidewall configured to receive the connecting member, a plurality of terminals disposed on the body and electrically connected to the connecting member, and a cover. The cover includes a rotation axis coupled to an upper portion of the body, a fixing portion extending from the rotation axis to hold the fixing member such that the fixing portion is substantially parallel to the base of the body, and a protrusion portion protruding from the rotation axis. The connector is electrically attached to the driving part and electrically connects the driving part to the connecting member.

With the presence of the protrusion portion, physical and electrical damages of the driving part are reduced. Further, flow of foreign substances between the connector and the body is decreased. Therefore, defect rate is decreased and the yield of the display apparatus is increased.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

It should be understood that the exemplary embodiments of the present invention described below may be modified in many different ways without departing from the inventive principles disclosed herein, and the scope of the present invention is therefore not limited to these particular flowing embodiments. Rather, these embodiments are provided so that this disclosure will be thorough and complete, and will fully convey the concept of the invention to those skilled in the art by way of example and not of limitation.

Hereinafter, the embodiments of the present invention will be described in detail with reference to the accompanied drawings.

Figure 1:
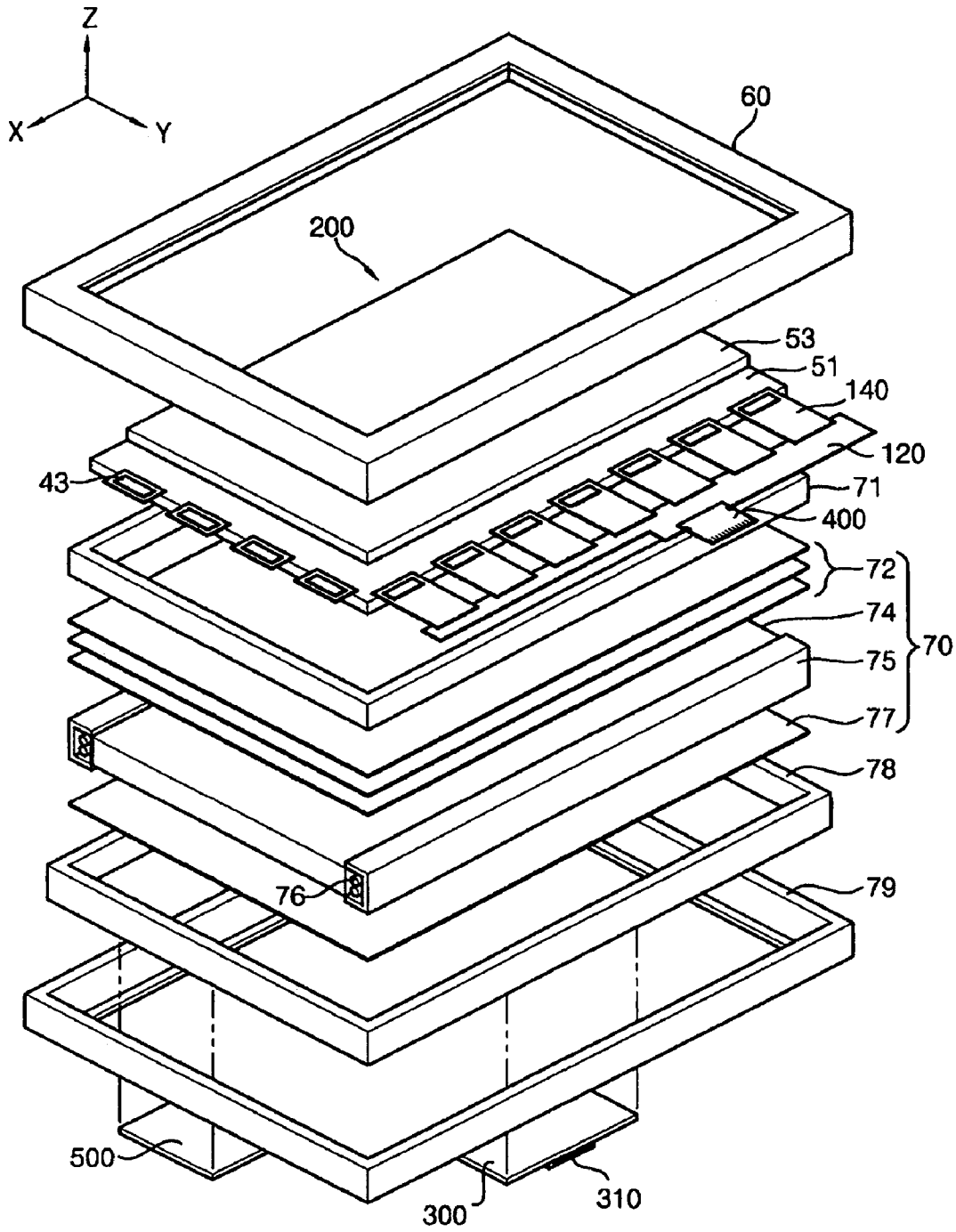
FIG. 1 is an exploded perspective view illustrating a liquid crystal display apparatus in accordance with an example embodiment of the present invention.
Figure 2:
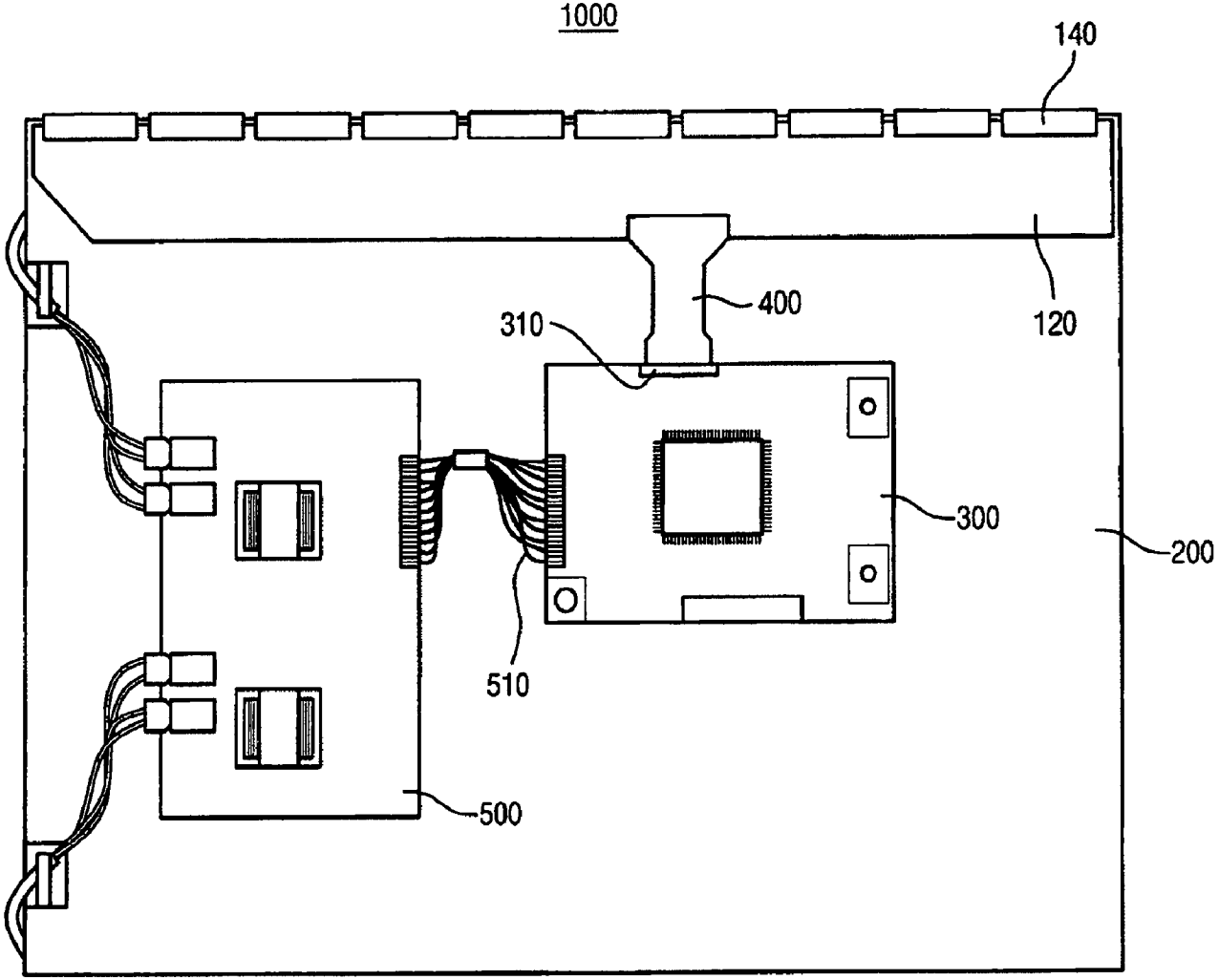
FIG. 2 is a plan view illustrating a rear side of the liquid crystal display apparatus of FIG. 1.

FIG. 1 is an exploded perspective view illustrating a liquid crystal display apparatus in accordance with an embodiment of the present invention. FIG. 2 is a plan view illustrating a rear side of the liquid crystal display apparatus in FIG. 1. As shown in the exploded perspective view, the upper portion is the "front" of the apparatus and the bottom portion is the "rear" of the apparatus.

Referring to FIGS. 1 and 2, the liquid crystal display apparatus includes a liquid crystal display panel 200, an integral printed circuit board 120, a flexible circuit board 400, a backlight assembly 70, a top chassis 60, a lower mold frame 78, a bottom chassis 79, an inverter 500, a control board 300 and a connector 310.

The liquid crystal display panel 200 includes an array substrate 51, a color filter substrate 53, a liquid crystal layer (not shown), a gate tape carrier package (TCP) 43 and a data tape carrier package 140.

The array substrate 51 includes a thin film transistor (not shown), a gate line (not shown) electrically connected to the gate TCP 43 and a gate electrode of the thin film transistor, a data line (not shown) electrically connected to the data TCP 140 and a source electrode of the thin film transistor, and a pixel electrode (not shown) electrically connected to a drain electrode of the thin film transistor.

The color filter substrate 53 includes a color filter (not shown), a common electrode (not shown), etc. The color filter transmits only light having a particular wavelength.

The liquid crystal layer is between the array substrate 51 and the color filter substrate 53. When a data voltage and a common voltage are respectively applied to the pixel electrode of the array substrate 51 and the common electrode of the color filter substrate 53, an electric field is formed between the pixel electrode and the common electrode to change an alignment of liquid crystal molecules. When the alignment of the liquid crystal molecules is changed, light transmittance through the liquid crystal layer is changed to display a desired image.

The gate TCP 43 is electrically connected to an end of the gate line. A gate-driving chip is disposed on an upper portion of the gate TCP 43 to apply a gate signal to the gate line. Here, the gate-driving chip may be directly mounted on the array substrate 51 by a chip on glass (COG) process. Alternatively, a gate driving circuit may be directly formed on the array substrate 51 to omit the gate-driving chip.

The data TCP 140 is disposed between an end of the data line and the integral printed circuit board, and electrically connected to both the end of the data line and the integral printed circuit board. A data-driving chip is disposed on an upper portion of the data TCP 43 to apply a data signal to the gate line. The data-driving chip may be directly mounted on the array substrate 51 through a chip on glass (COG) process.

The integral printed circuit board 120 controls a driving signal applied to the integral printed circuit board 120 through the control board 300 to apply the driving signal to the data TCP 140 and the gate TCP 43. When the apparatus is assembled, the data TCP 140 bends toward the rear side of the bottom chassis 79 to wrap around several layers of the components shown in FIG. 1, so that the integral printed circuit board 120 is placed at the rear side of the bottom chassis 79 (see FIG. 2). The flexible circuit board 400 is received by the connector 310.

The flexible circuit board 400 is between the integral printed circuit board 120 and the control board 300 to connect the integral printed circuit board 120 to the control board 300. The flexible circuit board 400 includes a flexible film (410 in FIG. 9) including an insulating material and a conductive pattern (420 in FIG. 9) attached to the flexible film. The conductive pattern includes a metal having an excellent conductivity such as copper, chromium, etc. One end of the flexible circuit board 400 is attached to the integral printed circuit board 120 through an anisotropic conductive film (ACF). The other end of the flexible circuit board is electrically connected to the connector 310.

Figure 3:
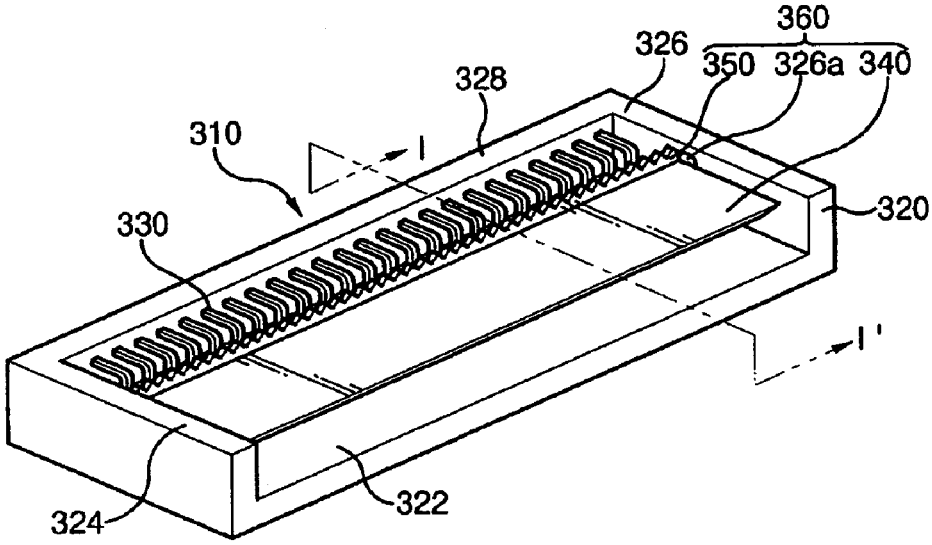
FIG. 3 is a perspective view illustrating a connector for the apparatus of FIG. 2.
Figure 4:
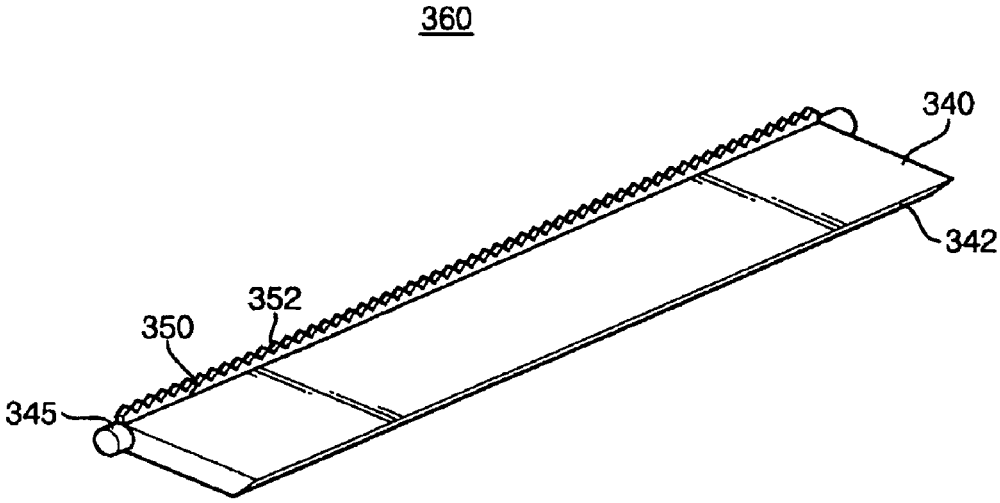
FIG. 4 is a perspective view illustrating a cover for the connector of FIG. 3.
Figure 5:
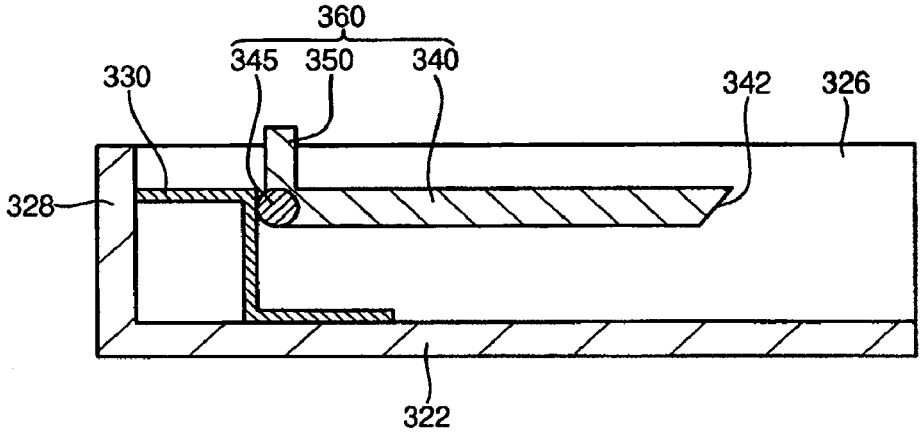
FIG. 5 is a cross-sectional view taken along the line I-I' in FIG. 3.

FIG. 3 is a perspective view illustrating a connector in FIG. 2. FIG. 4 is a perspective view illustrating a cover in FIG. 3. FIG. 5 is a cross-sectional view taken along the line I-I' in FIG. 3.

Referring to FIGS. 2 to 5, a connector 310 includes a body 320, a plurality of terminals 330 and a cover 360.

The body 320 includes a base 322, and first to third sidewalls 324, 326 and 328 extending from the base 322 so as to receive the flexible circuit board 400 that is inserted into the body 320. The first and second sidewalls 324 and 326 are opposite to each other, and the third sidewall 328 is disposed between the first and second sidewalls 324 and 326. Hinges **326*a* are formed on the first and second sidewalls 324 and 326. The hinge 326*a* formed on the first sidewall 324 corresponds to the hinge 326*a* formed on the second sidewall 326. Although the connector 310 generally has a rectangular cube shape, two surfaces of the cube are open to facilitate the placement of the flexible circuit board 400 in the connector 310 (see FIG. 2). In the embodiment of FIG. 3, the surfaces that are open are one of the side faces parallel to the third sidewall 328 and an upper face parallel to the base 322**.

The terminals 330 are disposed in the body 320 to couple to a plurality of the conductive patterns (420 in FIG. 9) formed on the flexible circuit board 400. The terminals 330 are fixed to the third sidewall 328 of the body 320 and the base 322, and electrically connected to a plurality of signal lines (not shown) formed on the control board 330. Therefore, the terminals 330 electrically connect the conductive patterns of the flexible circuit board 400 to the signal lines of the control board 300, respectively.

The cover 360 is coupled to an upper portion of the body 320 through the hinges 326*a*. The cover 360 includes a rotation axis 345, a protrusion portion 350 and a fixing portion 340.

The rotation axis 345 is pivoted to the hinges 326*a* to rotate the cover 360.

The protrusion portion 350 extends from the rotation axis 345 in a direction substantially perpendicular to the base 322, and includes a plurality of projections 352 at an upper portion of the protrusion portion 350. When the flexible circuit board 400 is disposed on the protrusion portion 350 during an assembling process, the flexible circuit board 400 is spaced apart from the terminals 330 and the control board 300, so that the flexible circuit board 400 may be protected from damages due to external impacts such as an electric impact, a physical impact, etc. Further, the protrusion portion 350 prevents foreign substances from flowing in between the cover 360 and the body 320. In FIG. 3, the projections 352 increase a frictional force between the protrusion portion 350 and the flexible circuit board 400 (shown in FIG. 2). Thus, the projection projections 352 restrict horizontal movement of the flexible circuit board 400 to prevent the flexible circuit board 400 from contracting the terminals 330 and the control board 300.

The fixing portion 340 extends from the rotation axis 345 in a plane substantially parallel to the base 322, and has a plate shape. The base 322 compresses the flexible circuit board 400 to hold the flexible circuit board 400. In the present embodiment, a side face 342 of the fixing portion 340 is inclined by a predetermined angle with respect to an upper face of the fixing portion 340. Since the side face of the fixing portion 340 is inclined, the cover 360 is easy to be rotated to reduce processing time and damage of the cover 360 during the assembling process.

In the connector that is shown, the rotation axis 345 is positioned adjacent to the terminals 330 to prevent the foreign substances from flowing in between the cover 360 and the body 320. The rotation axis 345 may be spaced apart from the terminals 330 in other embodiments.

Referring to FIGS. 1 and 2, the control board 300 converts an image signal received from an external device into a driving signal to apply the driving signal to the integral printed circuit board 120 through the flexible circuit board 400. The control board 300 is electrically connected to the inverter 500 through a cable 510.

The inverter 500 applies a power signal to the control board 300.

The backlight assembly 70 includes a light source 76, a light source cover 75, a light guide plate 74, a reflecting plate 77 and an optical sheet 72. The backlight assembly 40 provides a planar light to the liquid crystal display panel 200.

The light source cover 75 protects the light source 76, and reflects a linear light generated from the light source toward the light guide plate 74.

The light guide plate 74 is disposed adjacent to the light source 76 to convert the linear light emission into planar light, and guides the planer light toward the optical sheet 72.

The reflecting plate 77 is disposed under the light guide plate 74, and reflects light that leaked from the light guide plate 74 toward the optical sheet 72.

The optical sheet 72 improves the property of light exiting from the light guide plate 74 and provides light to the liquid crystal display panel 200. The optical sheet 72 may include a diffusion plate uniformizing the brightness of light, a prism sheet enhancing the front-brightness, and a protection film, among others.

The lower mold frame 78 is disposed under the backlight assembly 70 to prevent the backlight assembly 70 from moving horizontally. The lower mold frame 78 has a frame-shape i.e., a base portion of the lower mold frame 78 has an opening. A step portion (not shown) may be formed in the lower mold frame 78 to support the optical sheet, etc.

The upper mold frame 71 is placed between the liquid crystal display panel 200 and the backlight assembly 70 to hold the backlight assembly 70 and support the liquid crystal display panel 200. The upper mold frame 71 has a frame-shape, i.e. a base portion of the upper mold frame 71 has an opening.

The bottom chassis 79 is disposed under the lower mold frame 78, and includes a bottom plate and sidewalls extending from an edge portion of the bottom plate. The bottom chassis 79 receives the liquid crystal display panel 200, the upper mold frame 71, the backlight assembly 70 and the lower mold frame 78.

The top chassis 60 is coupled to the bottom chassis 79 to hold the liquid crystal display panel 200. The top chassis 60 includes an upper plate with an opening and sidewalls extending from the upper plate.

FIGS. 6 to 9 are cross-sectional views illustrating a method of connecting a flexible printed circuit board to a connector in accordance with an embodiment of the present invention.

Figure 6:
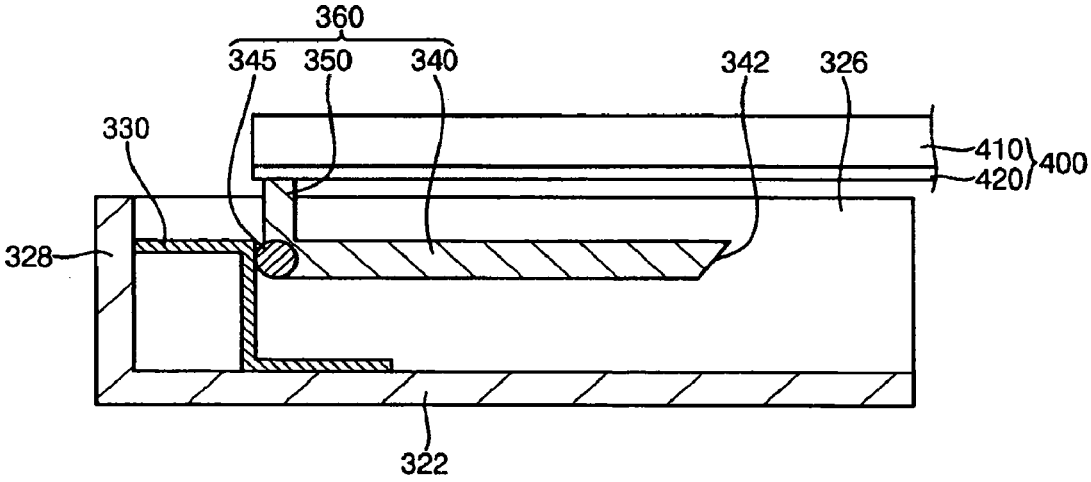
FIGS. 6 to 9 are cross-sectional views illustrating a method of connecting a flexible printed circuit board to a connector in accordance with an embodiment of the present invention.

Referring to FIGS. 2 and 6, the flexible circuit board 400 is arranged on the protrusion portion 350. The conductive pattern 420 of the flexible circuit board 400 is disposed under the flexible film 410. The integral printed circuit board 120 is electrically connected to the liquid crystal display panel 200 through the flexible circuit board 400. The flexible circuit board 400 is spaced apart from the terminals 330 and the control board 300 by a predetermined distance due to an interruption of the protrusion portion 350. The connector 310 may be formed through various methods. For example, an insulating material such as a synthetic resin may be molded to form the body 320, and a plurality of metal lines may be mounted on the body 320 to form the terminals 330. In addition, an insulating material such as a synthetic resin may be molded to form the cover 360, and the rotation axis 345 of the cover 360 may be inserted into a recess formed on an inner surface of the side face 342 of the body 320.

Therefore, the protrusion portion 350 prevents the flexible circuit board 400 from sagging during an assembling process, to thereby prevent the flexible circuit board 400 from making contact with the terminals 330 and the control board 300.

Figure 7:
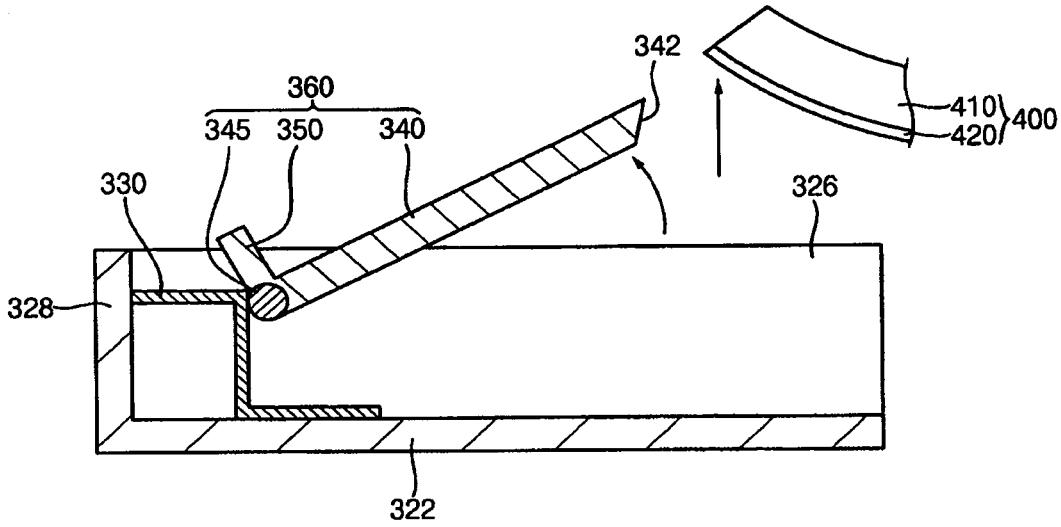

Referring to FIG. 7, the flexible circuit board 400 is lifted to form a space for movement of the cover 360. The cover 360 is rotated in a first rotational direction of the rotation axis 345. The first rotational direction is a counter clockwise direction in FIG. 7. Therefore, the fixing portion 340 of the cover 360 is lifted.

Figure 8:
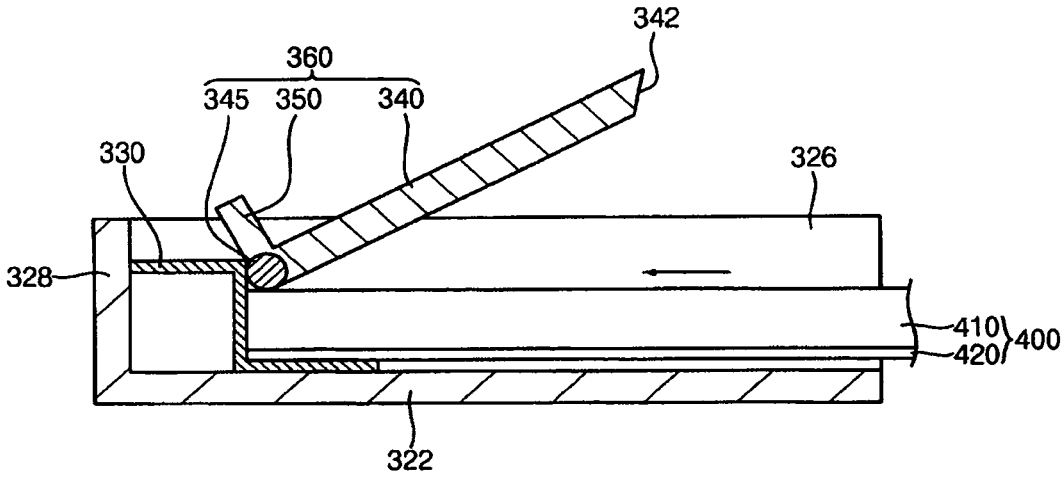

Referring to FIG. 8, when the cover 360 is rotated in the first rotational direction, the flexible circuit board 400 is inserted into the opened portion of the body 320 to electrically connect the conductive pattern 420 of the flexible circuit board 400 to the terminals 330.

Figure 9:
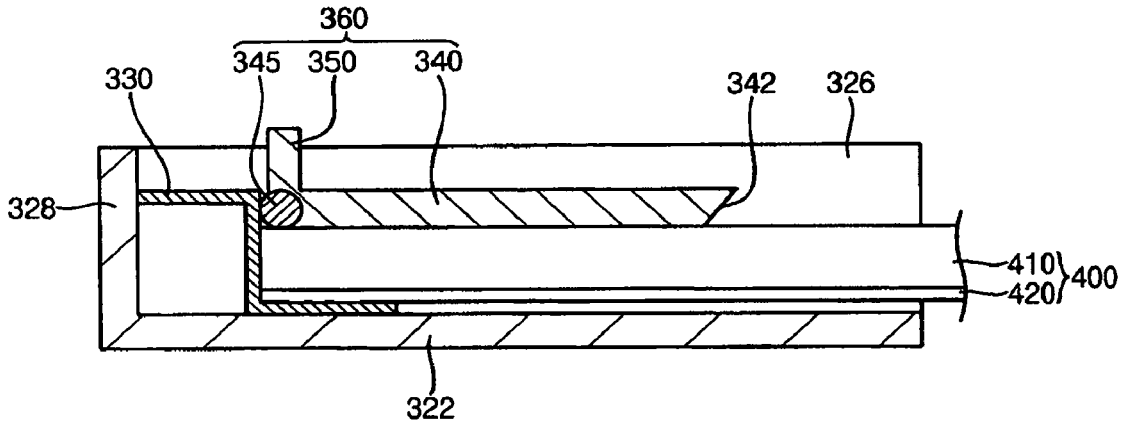

Referring to FIG. 9, the cover 360 is rotated in a second rotational direction that is opposite to the first rotational direction such that the fixing portion 340 is disposed in a plane that is substantially parallel to the plane of the body 320. This way, the flexible circuit board 400 is fixed to the body 320 of the connector 310. That is, the fixing portion 340 of the cover 360 fastens the flexible circuit board 400 to the body 320 of the connector 310.

According to the above, since the connector 310 includes the protrusion portion 350, physical and electrical damages to driving parts are reduced. Further, flow of foreign substances into a gap between the connector and the body is decreased.

Therefore, defect rate is decreased, and thus a yield of the display apparatus is increased.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method of connecting a first electrical circuit having at least a conductive pattern to a second electrical circuit, the method comprising:

providing a connector including a body that has a base and a sidewall, a plurality of terminals on the body, and a cover, wherein the cover includes:

a rotation axis coupled to an upper portion of the body, a fixing portion extending from the rotation axis in a predetermined direction, and a protrusion portion protruding from the rotation axis in a direction substantially perpendicular to the rotation axis;

disposing the first electrical circuit over the cover such that an end portion of the first electrical circuit makes contact with the protrusion portion;

rotating the cover in a first rotational direction of the rotation axis such that the first electrical circuit is inserted under the cover and the conductive pattern of the first electrical circuit makes contact with the terminals;

rotating the cover in a second rotational direction opposite to the first rotational direction such that the fixing portion of the cover fixes the first electrical circuit to the body of the cover; and attaching the second electrical circuit to the body of the connector.

2. The method of claim 1, wherein the protrusion portion protrudes in a direction substantially perpendicular to the predetermined direction.

3. The method of claim 1, wherein the first electrical circuit includes a flexible circuit board and the second electrical circuit includes a control board.

4. The method of claim 1, further comprising rifting the first electrical circuit to generate a space for rotating the cover in the first rotational direction.

5. The method of claim 1, wherein the terminals have flat portions that make contact with the conductive pattern.

6. The method of claim 3, after disposing the first electrical circuit over the cover, wherein the protrusion portion supports the flexible circuit board to prevent the flexible circuit board from making contact with the terminals.

7. The method of claim 3, wherein the protrusion portion comprises a plurality of projections to prevent the flexible circuit board from moving horizontally.

* * * * *